US007422470B2

(12) United States Patent
Tsuji

(10) Patent No.: US 7,422,470 B2
(45) Date of Patent: Sep. 9, 2008

(54) WIRE COVER AND AN ASSEMBLING METHOD

(75) Inventor: Takeshi Tsuji, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/888,279

(22) Filed: Jul. 31, 2007

(65) Prior Publication Data

US 2008/0032544 A1 Feb. 7, 2008

(30) Foreign Application Priority Data

Aug. 2, 2006 (JP) ..... 2006-210899

(51) Int. Cl.
*H01R 4/64* (2006.01)

(52) U.S. Cl. ..... 439/470; 439/910

(58) Field of Classification Search ..... 439/470, 439/910, 465–467

See application file for complete search history.

(56) References Cited

U.S. PATENT DOCUMENTS 5,195,910 A * 3/1993 Enomoto et al. ..... 439/578
5,586,917 A * 12/1996 Yagi et al. ..... 439/752
5,967,830 A 10/1999 Tsuji
6,336,832 B2 * 1/2002 Nobe ..... 439/857
6,981,890 B2 * 1/2006 Cutler et al. ..... 439/441
7,201,592 B2 4/2007 Hata
7,316,575 B2 * 1/2008 Muschketat ..... 439/76.1

FOREIGN PATENT DOCUMENTS

EP 1 022 814 A2 7/2000
JP 2004-265765 9/2004

* cited by examiner

*Primary Examiner*—Gary F. Paumen
(74) *Attorney, Agent, or Firm*—Gerald E. Hespos; Anthony J. Casella

(57) ABSTRACT

A wire cover is provided for enabling a held state of a corrugate tube to be confirmed visually. Since tube holders (19) into which a front end portion of the corrugate tube (30) is fitted are formed with through holes (23A, 23B) and (23C) penetrating from the outer circumferential surface to the inner circumferential surface, a held state of the corrugate tube (30) fitted in the tube holders (19) of the wire cover (10) can be confirmed by the eyes through the through holes (23A, 23B) and (23C). Further, since water inside the wire cover (10) is drained out through the through holes (23A, 23B) and (23C), water is unlikely to stay inside the wire cover (10).

12 Claims, 10 Drawing Sheets

WIRE COVER AND AN ASSEMBLING METHOD

BACKGROUND OF THE INVENTION

1. Field of the Invention

The invention relates to a wire cover for protecting drawn-out parts of wires and to an assembling method thereof.

2. Description of the Related Art

U.S. Pat. No. 7,201,592 discloses a wire cover to protect wires drawn out from a rear end of a connector. The wire cover is formed by two opposed cover housings and has opposite first and second ends. The first end of the wire cover is mounted on the rear end of the connector from which the wires are drawn. The second end of the wire cover is mounted on an end of a corrugate tube through which the wires are inserted. Fitting recesses and projections are formed on the inner circumferential surface of the second end of the wire cover and engage ribs and grooves formed on the outer circumferential surface of the corrugate tube. One cover housing is mounted on the corrugate tube by engaging the fitting recesses and projections with the ribs and grooves of the corrugate tube. The other cover housing then is mounted on the corrugate tube so that the fitting recesses and projections similarly engage the ribs and grooves, and so that both cover housings are united. Thus, the fitting recesses and projections of the tube holder engage respectively with the ribs and grooves of the corrugate tube and the corrugate tube is held in the wire cover.

The above-described wire cover does not permit a visual check of the depth of insertion of the corrugate tube in the tube holder after the cover housings have been united. Thus, there is a possibility of leaving the corrugate tube at a shallower position than specified. There also is a possibility of improperly engaging the fitting recesses and projections with the ribs and grooves so that the corrugate tube is squashed and held in a squashed state. The holding force on a squashed corrugate tube might be not sufficient.

The invention was developed in view of the above situation and an object thereof is to provide a wire cover enabling a held state of a corrugate tube to be confirmed or detected, particularly by the eyes.

SUMMARY OF THE INVENTION

The invention relates to a wire cover with two members that can be united to form a tube. The wire cover has a connector mounting end that is mountable on a connector from which wires are drawn. A tube holder is formed at the end of the wire cover opposite the connector mounting end and can receive an end of a tube through the wires are insertable. At least one through hole penetrates the tube holder of the wire cover from the outer peripheral surface to the inner peripheral surface thereof. Thus, an operator can visually confirm the held state of the tube in the tube holder of the wire cover at the through holes. Further, fluid, such as water, inside the wire cover will drain out through the through hole and will not stay inside the wire cover.

The tube preferably is a corrugate tube. The inner peripheral surface of the tube holder of the wire cover preferably has at least one fitting projection and/or at least one fitting recess for engaging at least one groove and/or at least one rib formed in the outer circumferential surface of the corrugate tube.

The through holes preferably are at substantially opposite sides of an axial line of the two members that are assembled to form the wire cover. Thus, the inside of the wire cover can be seen at opposite sides of the axial line to avoid leaving the tube with one side displaced. Further, fluid can be drained from the wire cover more reliably since one of the through holes will be at a lower side regardless of the orientation of the wire cover.

Water is likely to accumulate in the fitting recess of the tube holder. Thus, the through holes preferably are formed in a fitting recess so that water can be drained efficiently.

Plural fitting recesses preferably are arranged in a direction of the axial line at the substantially same pitches as the ribs.

The through holes preferably are formed at least in one of the fitting recesses that engages the rib of the corrugate tube closest to the connector when the corrugate tube is held at a specified depth in the tube holder. Thus, an observer can recognize that the corrugate tube is held at the specified depth if the rib can be seen through the through holes. On the other hand, the observer can recognize that the corrugate tube is held at a shallower position than the specified depth if the rib cannot be seen. Therefore, the corrugate tube will not be left mistakenly at the shallower position.

The width of the through holes in forward and backward directions preferably is substantially equal to the width of the ribs in forward and backward directions. Thus, the front or rear edge of the rib can be seen through the through holes even if the rib is displaced only slightly, and even slight displacements of the corrugate tube in forward and backward directions can be recognized.

The through holes preferably are formed in all the fitting recesses of the tube holder. Thus, fluid, such as water, can be drained more reliably.

One or more coupling holes preferably are provided in at least one of the members for engaging one or more coupling projections of the connector. One or more shake preventing portions preferably are provided on the rear side of the inner circumferential surface of at least part of the coupling holes to prevent the connector and the wire cover from shaking relative to each other.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
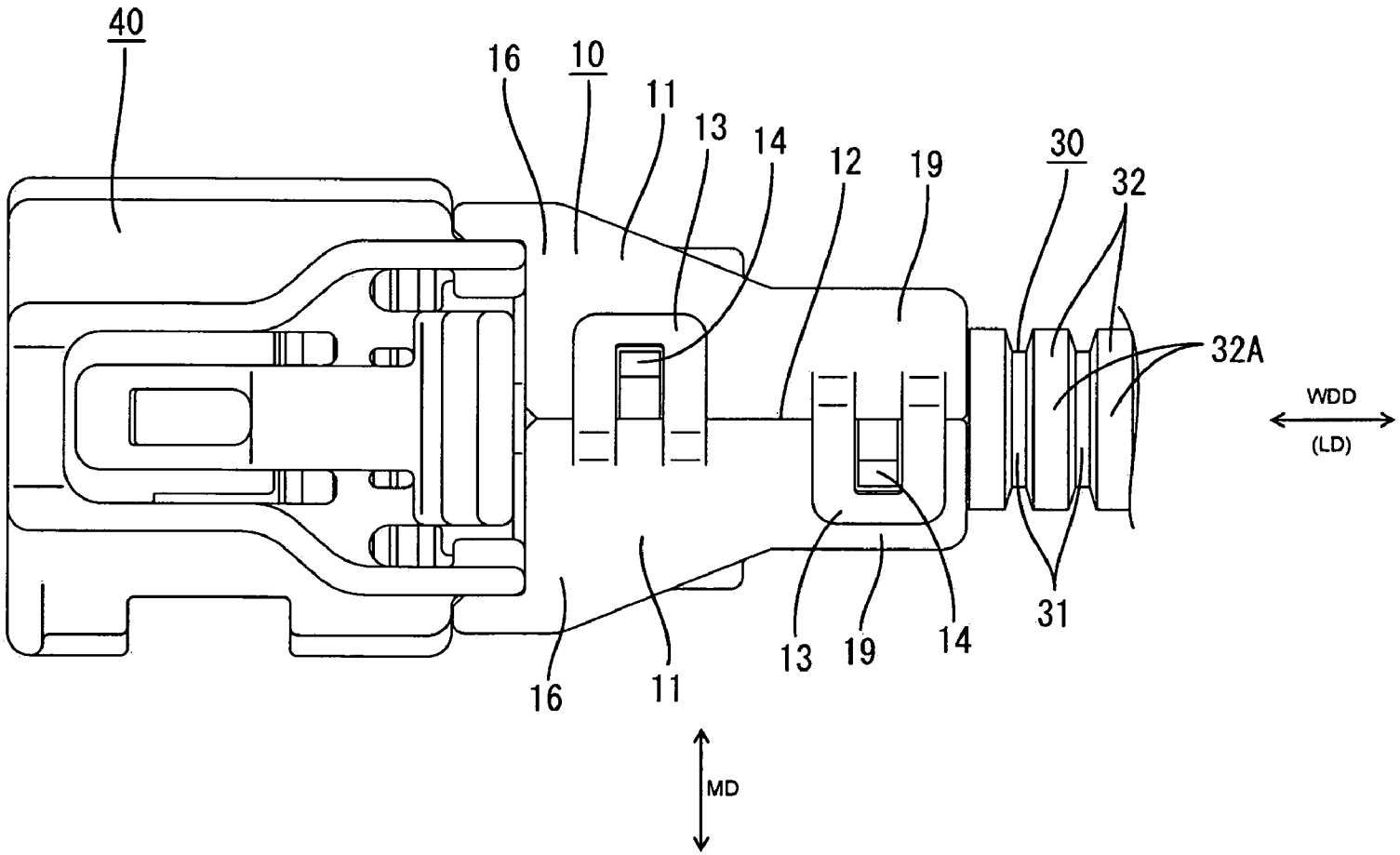
FIG. 1 is a plan view showing a state where a wire cover according to one embodiment is mounted on a connector.

A wire cover in accordance with the invention is identified generally by the numeral 10 in FIGS. 1 to 10. The wire cover 10 has one end mountable on a rear end of a connector 40 and has an opposite end mountable on a front end portion of a corrugate wire protection tube 30, as shown in FIG. 1, to protect exposed parts of wires 41 drawn from the rear end of the connector 40.

The corrugate tube 30 is made e.g. of a synthetic resin, and is in the form of bellows that has an outer circumferential surface with alternating grooves 31 and ribs 32. Thus, the corrugate tube 30 has sufficient flexibility to follow the arrangement path of the wires 41, and protects the wires 41 therein.

In the following description, a direction WDD (right in FIG. 1) in which the wires 41 are drawn from the connector 40 is referred to as a backward direction, and mounting directions MD (vertical directions in FIG. 1) of cover housings 11 of the wire cover 10 are referred to as transverse directions.

Figure 2:
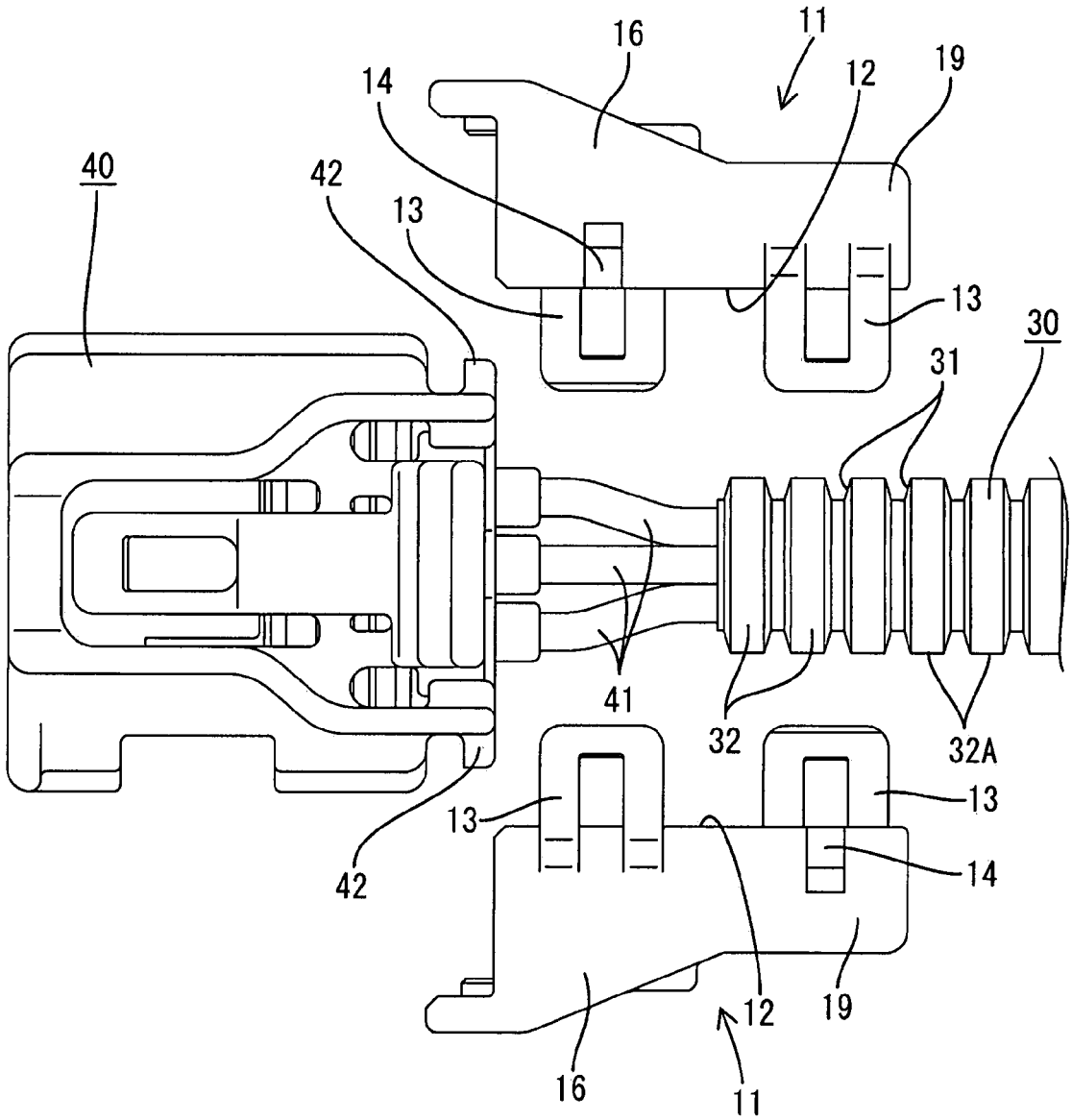
FIG. 2 is a plan view showing a state where the wire cover is detached from the connector.

The connector 40 is substantially in the form of a wide block, and unillustrated terminal fittings are accommodated inside. The wires 41 connected with the terminal fittings are drawn out from the rear end of the connector 40 and are inserted in the corrugate tube 30, as shown in FIG. 2. Two coupling projections 42 are provided on the rear end of the connector 40.

The wire cover 10 is mountable on the rear end of the connector 40 and is comprised of two substantially identical cover housings 11 that are made of a synthetic resin. The cover housings 11 are assembled into a substantially rectangular tube with the inner peripheral surfaces thereof substantially opposed to each other and abutment edges 12 thereof held substantially in abutment with each other.

As shown in FIG. 2, pairs of locking pieces 13 near the front and rear ends and project beyond the abutment surfaces 12. Interlocking projections 14 also are formed on the outer peripheral surface of the cover housings 11 and engageable with the corresponding locking pieces 13. The cover housings 11 are held assembled by the engagement of the corresponding locking projections 14 and locking pieces 13.

Figure 3:
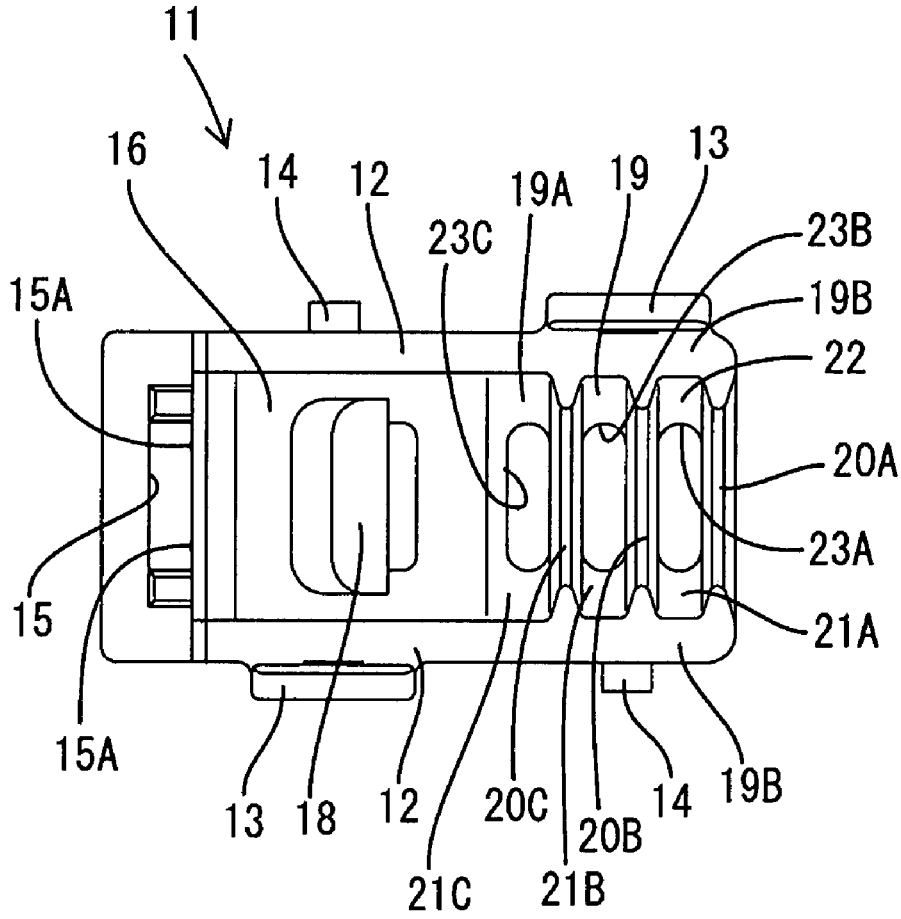
FIG. 3 is a side view of a cover housing viewed from an inner side.
Figure 4:
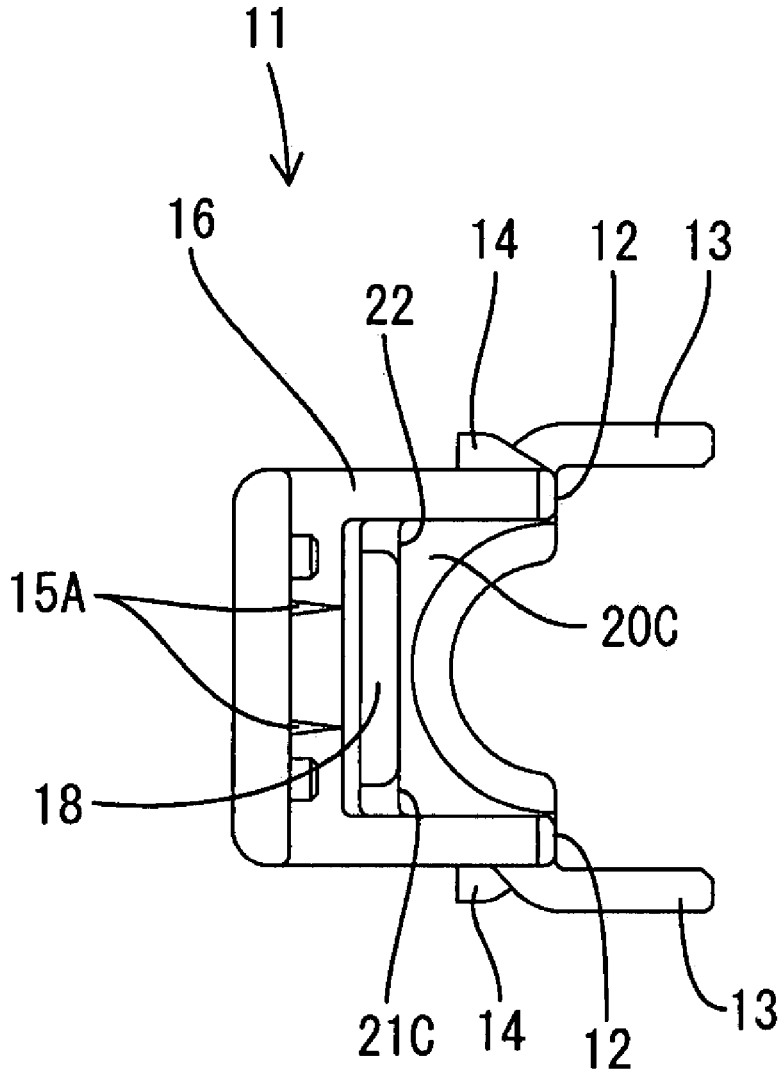
FIG. 4 is a front view of the cover housing.
Figure 5:
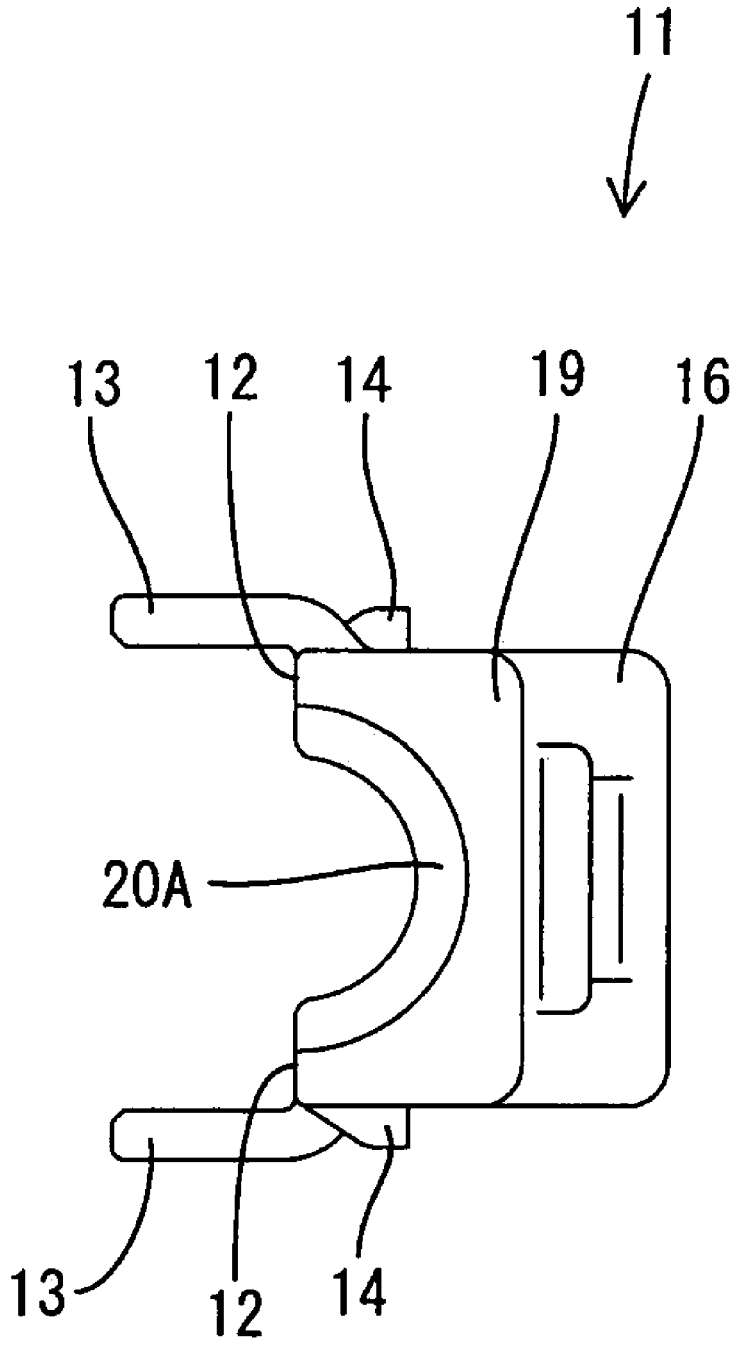
FIG. 5 is a rear view of the cover housing.

As shown in FIG. 3, coupling holes 15 are formed near the front ends of the cover housings 11 and engageable with the coupling projections 42 of the connector 40. The coupling holes 15 are rectangles that are longer in direction substantially normal to the wire draw out direction WDD (vertical direction in FIG. 3). The cover housings 11 are coupled to the rear end of the connector 40 by engaging the coupling holes 15 and respective coupling projections 42 (see FIG. 9). Shake preventing portions 15A are provided on the rear side of the inner circumferential surface of each coupling hole 15, as shown in FIGS. 3 and 4, to prevent the connector 40 and the wire cover 10 from shaking relative to each other.

A wire surrounding portion 16 is formed on front portions of the cover housings 11 for surrounding exposed parts of the wires 41 between the rear end of the connector 40 and the front end of the corrugate tube 30 when the cover housings 11 are assembled.

Figure 8:
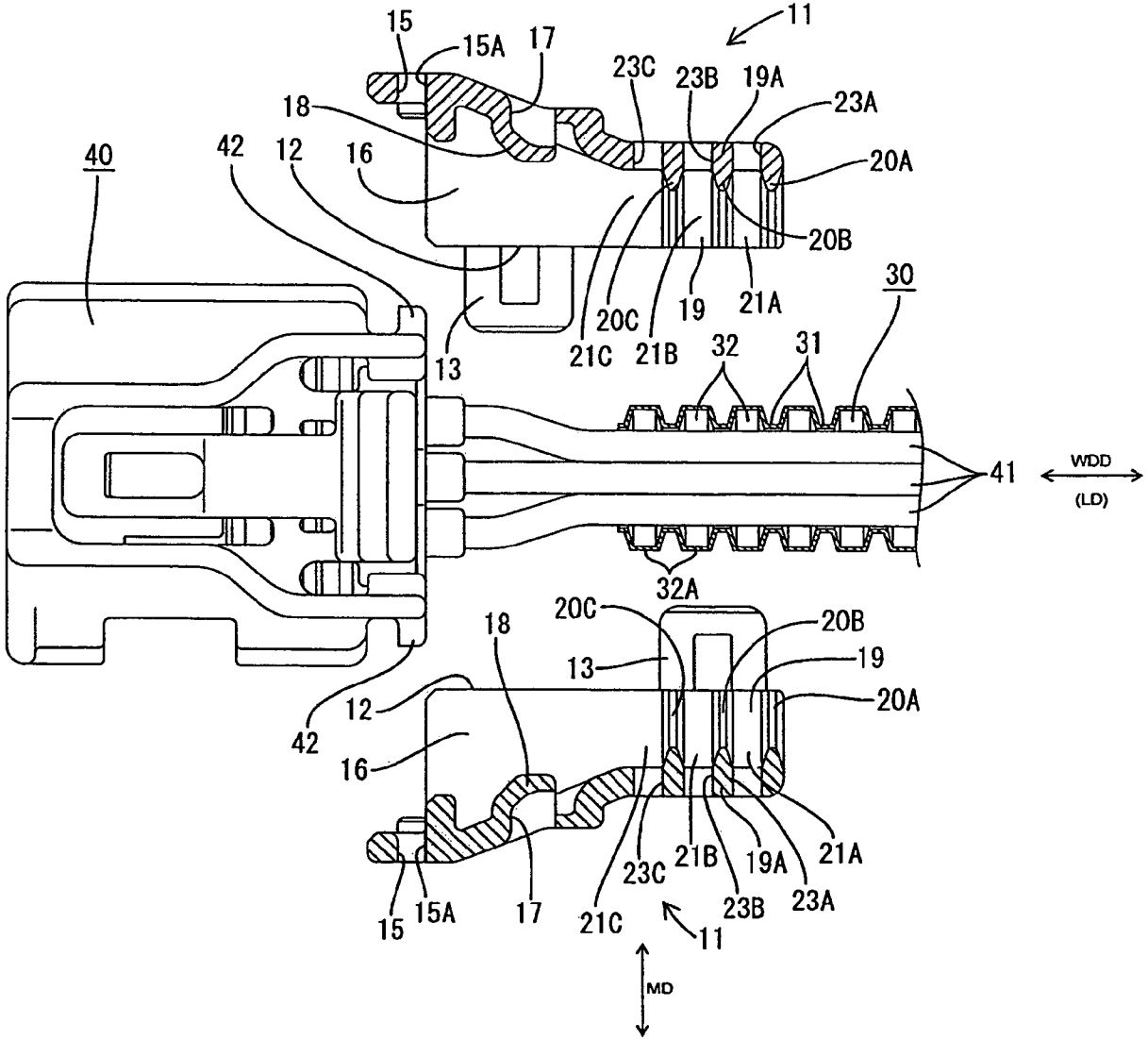
FIG. 8 is a section showing the state where the wire cover is detached from the connector.

Weep holes 17 provide communication between the inside and outside of the wire surrounding portion 16. The weep holes 17 have substantially rectangular cross-sections that are longer in a direction substantially normal to the wire draw out direction WDD. Shielding pieces 18 bulge in and back at the inner side of the weep holes 17, as shown in FIG. 8, so that the weep holes 17 define a crank-shape in the longitudinal direction. The shielding pieces 18 substantially cover the weep holes 17 so that water is not likely to enter inside, even if water splashes in all directions e.g. due to high-pressure cleaning or the like. However, the shielding pieces 18 permit water that has entered the wire surrounding portion 16 to drain through the weep holes 17.

Figure 6:
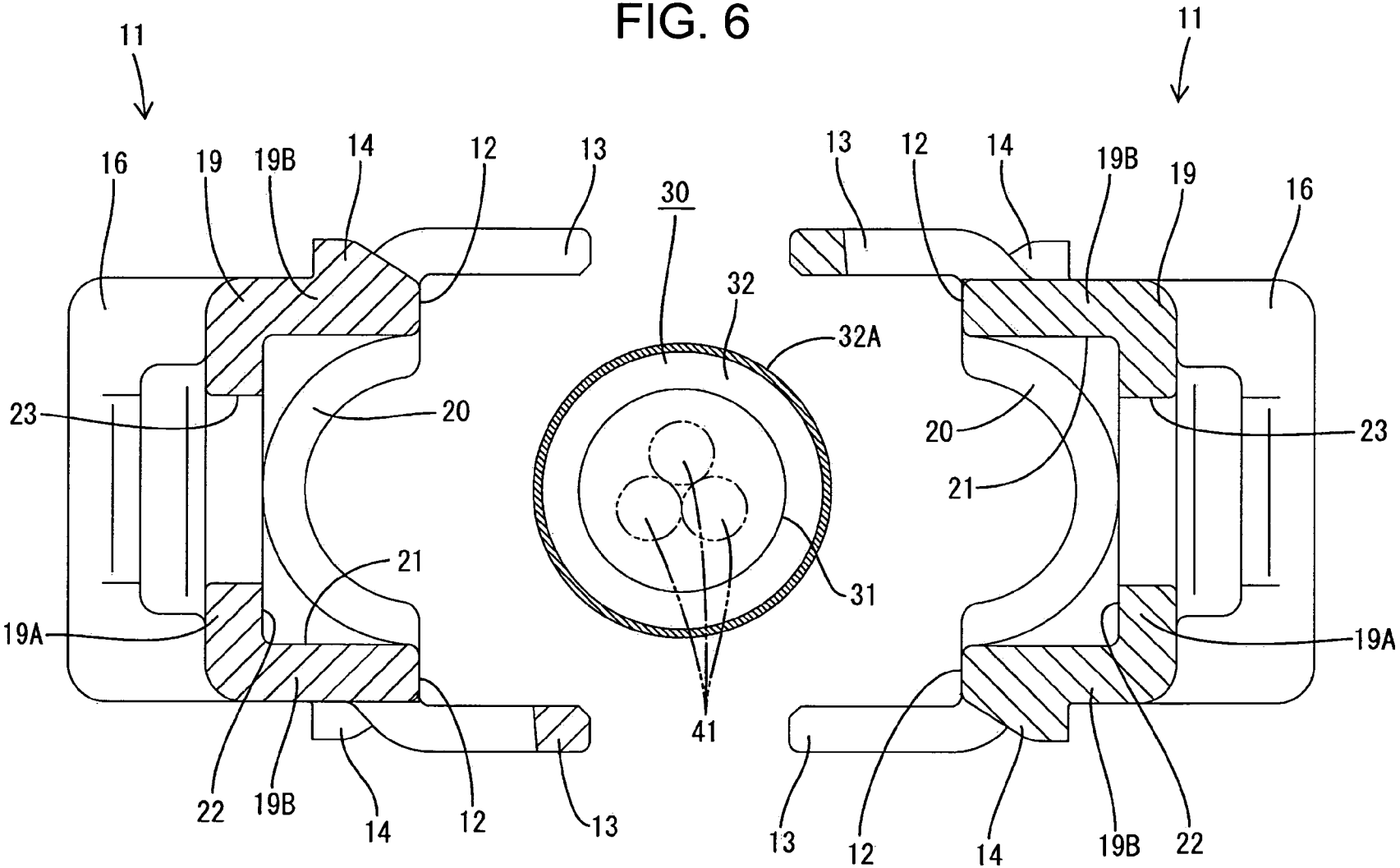
FIG. 6 is a section showing a state where the wire cover is detached from a corrugate tube.

Tube holders 19 are defined at rear portions of the cover housings 11, as shown in FIG. 8, for holding the front end of the corrugate tube 30 when the cover housings 11 are assembled. Each tube holder 19, as shown in FIG. 6, has a facing wall 19A substantially facing the mating facing wall 19A when the cover housings 11 are assembled, and two standing walls 19B that project substantially perpendicularly from opposite longitudinal edges of the facing wall 19A towards the mating side. The inner surface formed by the standing walls 19B and facing walls 19A has a substantially square cross-sectional shape for touching the outer projecting surfaces 32A of the ribs 32 of the corrugate tube 30 when the cover housings 11 are assembled around the corrugate tube 30.

Figure 7:
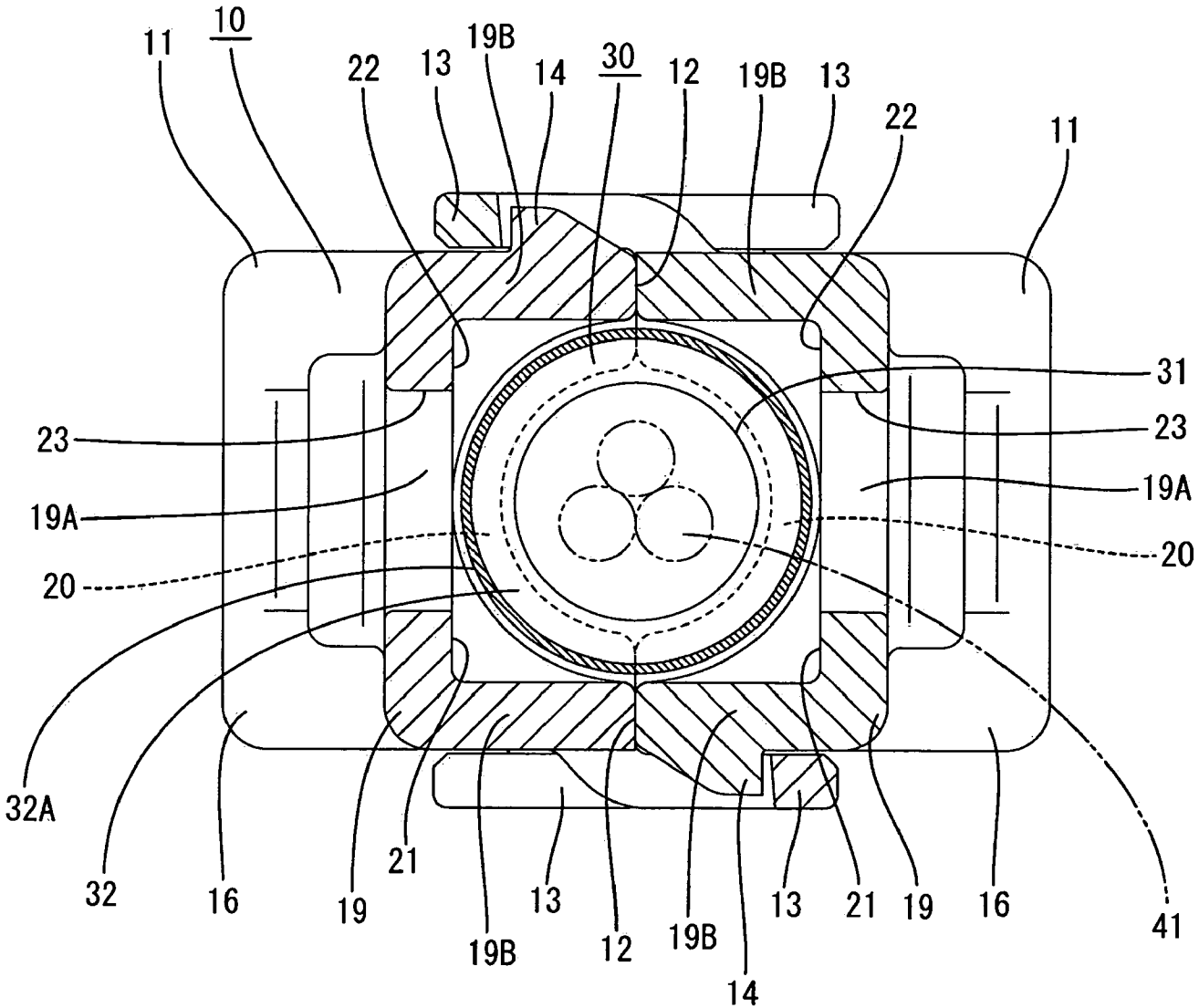
FIG. 7 is a section showing a state where the wire cover is mounted on the corrugate tube.

Fitting projections 20 and fitting recesses 21 are formed on the inner surface of each tube holder 19. The fitting projections 20 are engageable with the grooves 31 in the outer circumferential surface of the corrugate tube 30 and the fitting recesses 21 are engageable with the ribs 32 of the corrugate tube 30. The fitting projections 20 are substantially identically shaped and project substantially continuously in the circumferential direction from the inner surface of the facing wall 19A to the inner surfaces of the both standing walls 19B. Projecting end surfaces of the fitting projections 20 inscribe a substantially semicircular cross section substantially in conformity with the bottom surfaces of the grooves 31 of the corrugate tube 30. The projecting end surfaces of the fitting projections 20 form a circular shape substantially continuous in the entire circumference of the grooves 31, as shown in FIG. 7, when the cover housings 11 are assembled. Further, as shown in FIG. 9, the fitting projections 20 gradually taper towards their projecting ends in forward and backward directions for closely fitting into the grooves 31 of the corrugate tube 30.

A first fitting projection 20A is formed at the rear end of each cover housing 11, and second and third fitting projections 20B, 20C are arranged in this order forward from the first fitting projections 20A at substantially the same pitches as the ribs 32 of the corrugate tube 30. The first fitting projections 20A become continuous when the cover housings 11 are assembled thereby fulfilling a simple fluid- or waterproof function and a foreign matter entrance preventing function.

First and second fitting recesses 21A, 21B are defined between the first and second fitting projections 20A, 20B and between the second and third fitting projections 20B, 20C and a third fitting recess 21C is defined before the third fitting projection 20C. The three fitting recesses 21A, 21B and 21C are arranged at substantially the same pitches as the ribs 32 of the corrugate tube 30 in an axial direction (length direction LD of the wires 41). The width of bottom surfaces 22 of the fitting projections 21A, 21B and 21C (surfaces facing the projecting end surfaces 32A of the ribs 32) in forward and backward direction is substantially equal to the dimension of the projecting end surfaces 32A of the ribs 32 of the corrugate tube 30 in forward and backward directions.

Figure 9:
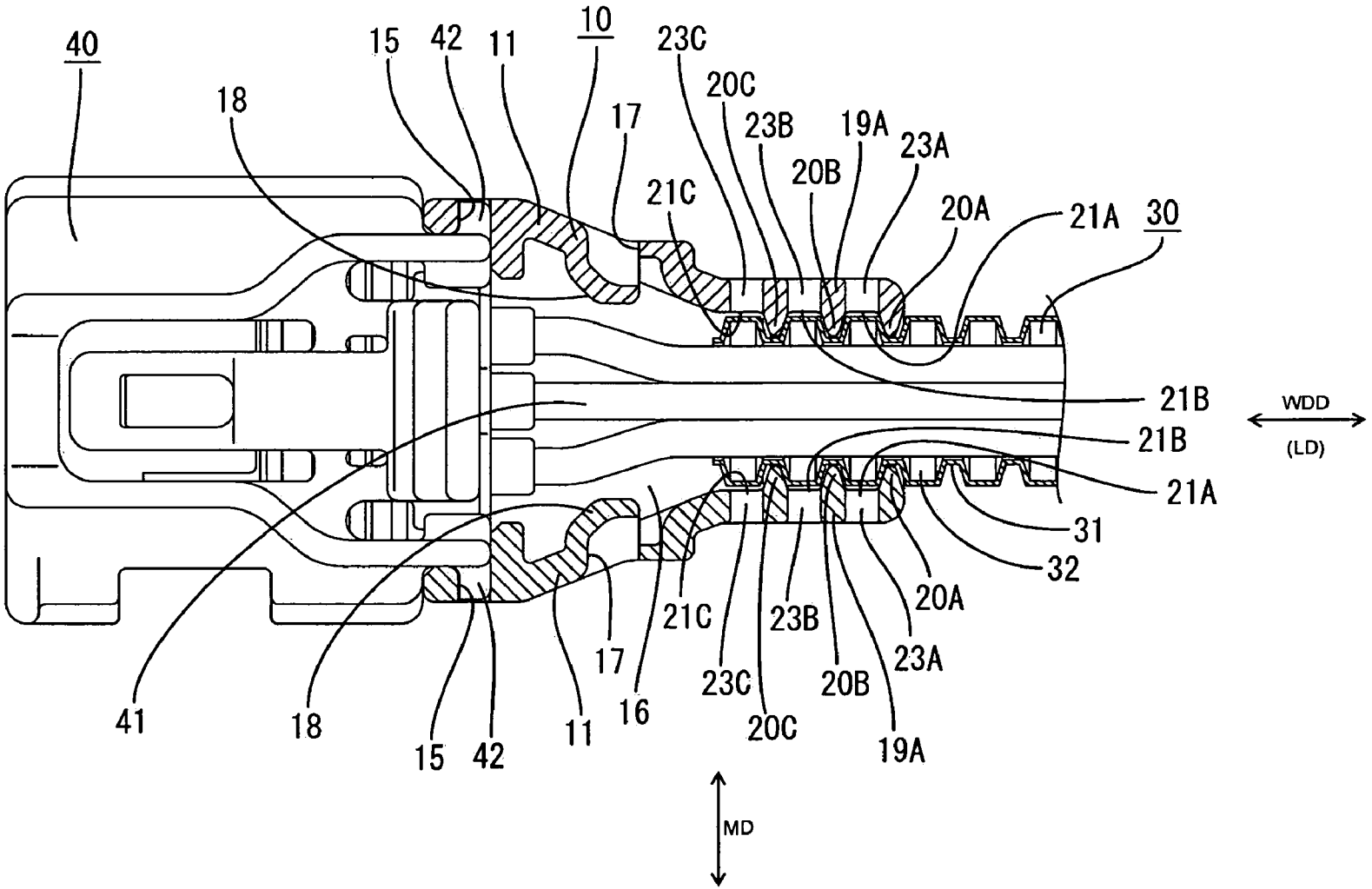
FIG. 9 is a section showing the state where the wire cover is mounted on the connector.
Figure 10:
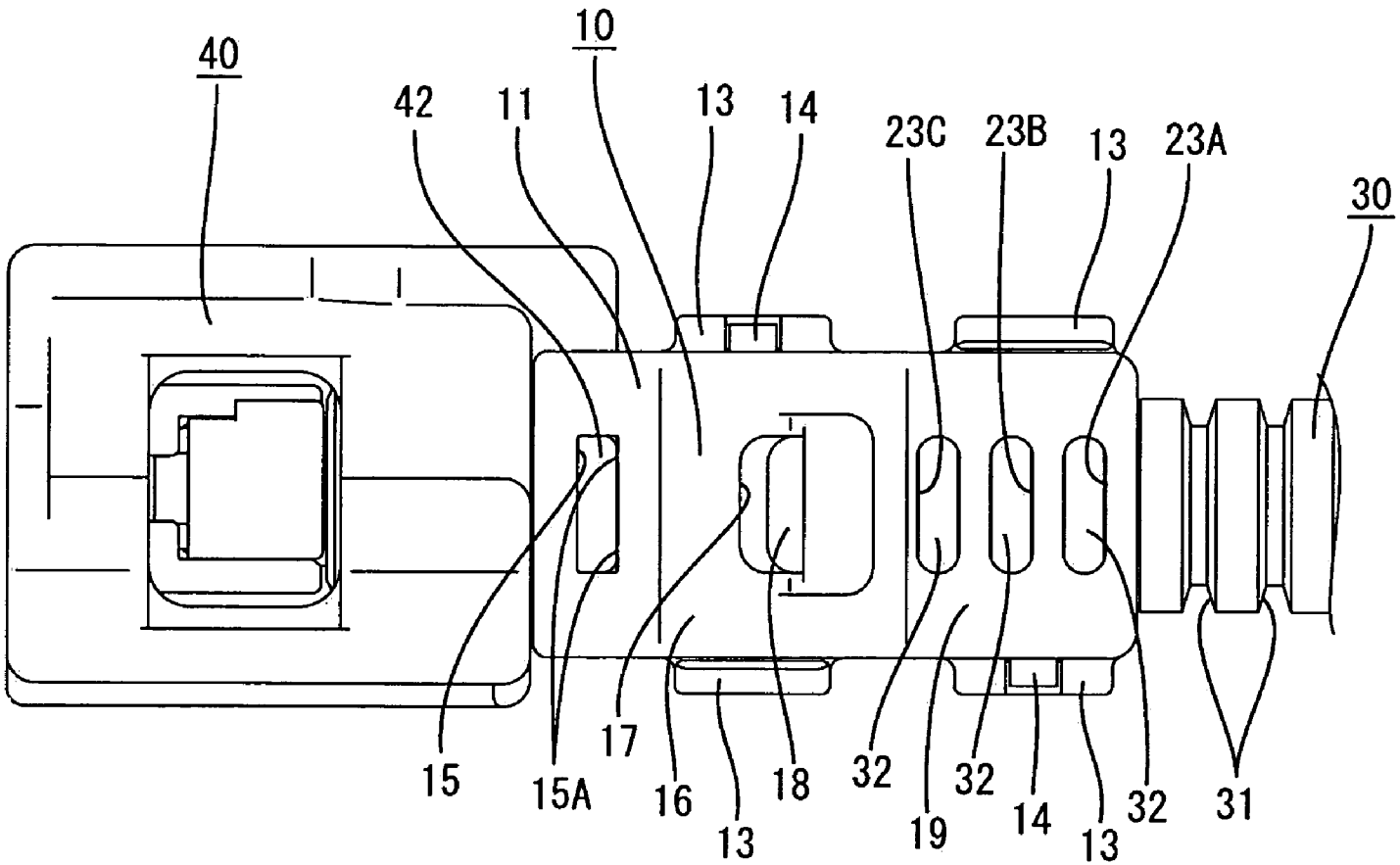
FIG. 10 is a side view showing the state where the wire cover is mounted on the connector.

As shown in FIG. 9, the fitting projections 20A, 20B and 20C engage the grooves 31 of the corrugate tube 30 and the ribs 32 of the corrugate tube 30 engage the fitting recesses 21A, 21B and 21C. Thus, the front end portion of the corrugate tube 30 fit into the tube holder 19 is held with a sufficient force. The third fitting recess 21C is the fitting recess 21 at the most forward position and is closest to the rear end of the connector 40 when the corrugate tube 30 is held at this specified depth to give a sufficient holding force.

Each tube holder 19 is formed with through holes 23 penetrating from the outer circumferential surface to the inner circumferential surface of the tube holder 19. At least first, second and third through hole 23A, 23B and 23C are formed respectively in the first, second and third fitting recesses 21A, 21B and 21C of the tube holder 19. The respective through holes 23A, 23B and 23C are formed in the facing walls 19A of the tube holders 19 and face each other at the opposite sides of an axial line of the cover housings 11 (i.e. corrugate tube 30) assembled with each other.

The through holes 23A, 23B and 23C have identical shapes in their longitudinal directions (vertical direction in FIG. 10), and opposite longitudinal ends thereof are rounded. Further, the width of the respective through holes 23A, 23B and 23C in forward and backward directions (draw-out direction WDD of the wires 41) is substantially equal to the width of the projecting end surfaces 32A of the ribs 32 of the corrugate tube 30 in forward and backward directions, and hence substantially equal to the width of the bottom surfaces 22 of the respective fitting recesses 21A, 21B and 21C in forward and backward directions. With the wire cover 10 mounted, the front and rear edges of the through holes 23A, 23B and 23C substantially align with the front and rear edges of the projecting end surfaces 32A of the respective ribs 32 when the through holes 23A, 23B and 23C are viewed from the outside (see FIG. 10).

The wires 41 connected with the terminal fittings are inserted through the corrugate tube 30 prior to assembling the wire cover 10 to the corrugate tube 30 or to the connector 40. The terminal fittings then are mounted into the connector 40. One of the cover housings 11 then is mounted on the front end of the corrugate tube 30 so that the fitting projections 20A, 20B and 20C and fitting grooves 21A, 21B and 21C thereof are positioned with respect to the grooves 31 and ribs 32 of the corrugate tube 30. Proper positioning of the ribs 32 relative to the corresponding fitting recesses 21A, 21B and 21C can be confirmed visually through the through holes 23A, 23B and 23C from outside the cover housing 11. The engagement of the fitting projections 20A, 20B and 20C and fitting recesses 21A, 21B and 21C with the corresponding grooves 31 and ribs 32 achieves a partial mounting of the one cover housing 11 on the corrugate tube 30. The coupling hole 15 of the same cover housing 11 then is coupled with the coupling projection 24 of the connector 40.

The other cover housing 11 then is positioned to engage the fitting projections 20A, 20B and 20C and fitting recesses 21A, 21B and 21C with the corresponding grooves 31 and ribs 32 of the corrugate tube 30. At this time, the position of the other cover housing 11 is adjusted so that the ribs 32 can be seen through all of the through holes 23A, 23B and 23C. The other cover housing 11 is mounted so that the abutment surfaces 12 of both cover housings 11 abut each other while the ribs 32 of the corrugate tube 30 are confirmed visually through the respective through holes 23A, 23B and 23C from outside both cover housings 11. The locking pieces 13 move onto the locking projections 14 and deform, but then resiliently restore simultaneously upon moving over the locking projections 14 to engage the locking projections 14 and to hold the cover housings 11 in an assembled state.

A worker can confirm whether the ribs 32 can be seen through the through holes 23A, 23B and 23C after assembly. An ability to see the ribs 32 through all of the through holes 23A, 23B and 23C confirms that the corrugate tube 30 is at the specified depth and that the respective fitting projections 20A, 20B and 20C and fitting recesses 21A, 21B and 21C are engaged properly with the corresponding grooves 31 and ribs 32. The holding force in this connected state is sufficient to resist a pulling force that acts when the corrugate tube 30 is pulled back in a direction to come out of the wire cover 10.

An inability to see the rib 32 through any of the through holes 23A, 23B and 23C indicates that the corrugate tube 30 has not reached that position. An improper connected state can be recognized even if the ribs 32 can be seen through the through holes 23, such as in the case where the ribs 32 are deformed. For example, if the front edge of the rib 32 seen through the third through hole 23C is in a middle part of the third through hole 23C, there is a possibility that the rear part of the rib 32 is squashed by the second fitting projection 20B. In such a case, the locking pieces 13 and locking projections 14 are disengaged with a jig, and both cover housings 11 are mounted again to reach a proper connected state while being positioned with respect to each other as described above. Thus, the corrugate tube 30 will not be left in a state where the holding force of the corrugate tube 30 is insufficient.

Fluid, such as water, might enter the wire cover 10 during use, and may drain through the weep holes 17 of the wire surrounding portion 16. However, there are cases where water runs down on the inner circumferential surface of the cover housings 11 and reaches the tube holder 19 without being drained through the weep holes 17. Here, all of the fitting recesses 21A, 21B and 21C of the tube holders 19 are formed with the through holes 23A, 23B and 23C. Thus, a fluid drop that reaches the tube holders 19 is drained out through the through hole 23 in any of the respective fitting recesses 21A, 21B and 21C. The through holes 23 are formed in all of the fitting recesses 21A, 21B and 21C, and therefore water is unlikely to stay in the tube holders 19. Further, the through holes 23A, 23B and 23C are arranged at opposite sides of the axial line of the wire cover 10. Thus, water drops may run down the inner circumferential surface to drain out through the through holes 23 at the lower side if the connector 40 is oriented so that the through holes 23 are arranged at the upper and lower sides. The connector 40 may be oriented so that the through holes 23 are arranged at the left and right sides and at an intermediate height. In this case, the abutment surfaces 12 are near the lower side and water drops may leak through a tiny clearance between the abutment surfaces 12. Therefore, water is not likely to stay inside the wire cover 10 for a long time regardless of the orientation of the connector 40 and the wire cover 10.

As described above, the through holes 23A, 23B and 23C penetrate from the outer circumferential surface to the inner circumferential surface of the tube holders 19 that receive the front end portion of the corrugate tube 30. Thus, the held state of the corrugate tube 30 in the tube holders 19 of the wire cover 10 can be confirmed visually through the through holes 23A, 23B and 23C. Further, water inside the wire cover 10 can drain out through the through holes 23A, 23B and 23C. In addition, the through holes 23A, 23B and 23C are formed in the corresponding fitting recesses 21A, 21B and 21C where water is likely to accumulate. Hence, water can be drained reliably and efficiently.

The through holes 23 are at substantially opposite sides of the axial line of the wire cover 10 when the cover housings 11 are assembled together. Thus, the inside of the wire cover 10 can be seen at opposite sides of the corrugate tube 30 to assure that the corrugate tube 30 is not left with one side displaced. Further, the wire cover 10 cannot be oriented so that the through holes 23 are only at the upper side, and water can be drained out reliably.

An ability to see the rib 32 through the third through holes 23C in the third fitting recesses 21C indicates that the corrugate tube 30 is held at the specified depth. However, an inability to see the rib 32 indicates that the corrugate tube 30 is at a shallower position than the specified depth. Therefore, the corrugate tube 30 will not be left inadvertently at the shallower position.

Further, the width of the through holes 23 in forward and backward directions is substantially equal to that of the ribs 32 in forward and backward directions and along the longitudinal direction of the corrugate tube 30. Hence, the front edges or rear edges of the ribs 32 can be seen through the through holes 23 even if the ribs 32 are only slightly displaced. Therefore, even slight displacements of the corrugate tube 30 in forward and backward directions can be recognized.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The invention is applied to the wire cover 10 formed by uniting the cover housings 11 as separate parts in the foregoing embodiment. However, the wire cover may be formed by two cover housings coupled by a hinge. Moreover, the cover may be formed by three or more parts coupled to each other. Furthermore, the single parts may be shaped in different ways.

The through holes 23 are formed in the fitting recesses 21 of the tube holders 19 in the foregoing embodiment. However, the through holes may be formed in the fitting projections or in areas extending from the fitting recesses to the fitting projections.

The width of the through holes 23 in forward and backward directions is substantially equal to that of the ribs 32 in forward and backward directions in the foregoing embodiment. However, the invention is not limited thereto and the width of the through holes 23 may be smaller or larger.

One through hole 23 is formed in each fitting recess 21 in the foregoing embodiment. However, plural through holes may be formed in each fitting recess and may be arranged or spaced in circumferential direction.

The through holes 23 are elongated in the foregoing embodiment, but may have any shape provided that the inside of the wire cover can be seen.

The through holes 23A, 23B and 23C are in all fitting recesses 21A, 21B and 21C in the foregoing embodiment. However, they may be formed in only one or two of the fitting recesses. Here, if the through hole is formed only in the third fitting recess, it can be confirmed whether the corrugate tube has been fit to the specified depth. For example, the through hole is formed only in the third fitting recess in one cover housing while being formed only in the first fitting recess in the other cover housing.

Although the substantially identically shaped cover housings 11 are united with each other and the through holes 23 are arranged at the opposite sides in the foregoing embodiment, the through holes may be arranged only at one side if cover housings of different shapes are assembled.

Although the through holes 23 face each other at the opposite sides of the axial line of the united cover housings 11 in the foregoing embodiment, they may not be necessarily arranged at facing positions.

Although the invention has been described with respect to a corrugate tube, it should be understood that it may be used in connection with any wire protection tube also not having corrugations or only partly having corrugations.

What is claimed is:

1. A wire cover, comprising at least two members configured to be united with one another to form a substantially tubular shape with opposite first and second ends, the first end of the wire cover being configured for mounted on a connector from which wires are drawn, the second end of the wire cover defining a tube holder configured for receiving an end portion of a tube through which the wires are insertable, portions of the wire cover between the ends being configured for surrounding parts of the wires between the connector and the tube, at least one through hole penetrating from an outer peripheral surface to an inner peripheral surface of the tube holder.

2. The wire cover of claim 1, wherein the tube is a corrugate tube, and wherein the inner peripheral surface of the tube holder is formed with at least one fitting projection and at least one fitting recess configured respectively for engaging at least one groove and at least one rib formed in the outer peripheral surface of the corrugate tube.

3. The wire cover of claim 2, wherein the through holes are arranged at opposite sides of an axial line of the members united with each other.

4. The wire cover of claim 2, wherein the at least one through hole is formed in the at least one fitting recess.

5. The wire cover of claim 4, wherein a plurality of fitting recesses are arranged in a direction of the axial line at substantially the same pitches as the ribs.

6. The wire cover of claim 5, wherein the at least one through hole comprises a through hole formed in the fitting recess that receives the rib of the corrugate tube that is closest to the connector when the corrugate tube is held at a specified depth in the tube holder.

7. The wire cover of claim 5, wherein the through holes have widths in forward and backward directions substantially equal to widths of the ribs in forward and backward directions.

8. The wire cover of claim 5, wherein the through holes are formed in all of the fitting recesses of the tube holder.

9. The wire cover of claim 1, further comprising at least one coupling hole in at least one of the members for engaging at least one coupling projection of the connector, and a shake preventing portion on an inner circumferential surface of the coupling hole for preventing the connector and the wire cover from shaking relative to each other.

10. A wire cover, comprising at least two members configured to be united with one another to form a substantially tubular shape with opposite first and second ends, an array of alternating fitting projections and fitting recesses extending substantially circumferentially around inner surface areas of the wire cover adjacent the second end of the wire cover, at least one through hole penetrating each of the fitting recesses from an inner peripheral surface to an outer peripheral surface of the tube holder.

11. The wire cover of claim 10, wherein the through holes are formed in each of the members of the wire cover.

12. An inspecting method, comprising the following steps:

providing a connector with wires drawn therefrom;

passing the wires through a tube;

providing two semi-tubular members each of which has a connector mounting structure at one end and a tube holder at an opposite end, the tube holder of each semi-tubular member being formed with at least one through hole;

assembling the semi-tubular members to one another to define a substantially tubular wire cover with the connector mounting structures of the semi-tubular members being mounted to the connector and the tube holders mounted to the tube; and inspecting the position of the tube relative to the through holes of the tube holder.

* * * * *